US005426664A

United States Patent [19]

Grove

[11] Patent Number: 5,426,664

[45] Date of Patent: Jun. 20, 1995

[54] WATER COOLED COPPER PANEL FOR A FURNACE AND METHOD OF MANUFACTURING SAME

[75] Inventor: Robert C. Grove, Brighton, Mich.

[73] Assignee: Nu-Core, Inc., Inkster, Mich.

[21] Appl. No.: 193,230

[22] Filed: Feb. 8, 1994

[51] Int. Cl.[6] ..... F27D 1/12

[52] U.S. Cl. ..... 373/76; 373/75; 110/336; 266/241

[58] Field of Search ..... 373/71–76; 432/77, 233, 237, 238; 266/241, 193; 219/137 R; 110/336

[56] References Cited

U.S. PATENT DOCUMENTS

| | | | |
|---|---|---|---|
| 3,795,786 | 3/1974 | Chanowitz | 219/137 R |
| 4,097,679 | 6/1978 | Fukumoto et al. | 373/76 |
| 4,207,060 | 6/1980 | Zangs | 432/77 |
| 4,221,922 | 9/1980 | Okimune | 373/76 |
| 4,273,949 | 6/1981 | Fischer et al. | 373/74 |
| 4,304,396 | 12/1981 | Udoh | 373/76 |
| 4,453,253 | 6/1984 | Lauria et al. | 373/74 |
| 4,617,673 | 10/1986 | Fuchs et al. | 373/80 |
| 4,637,034 | 1/1987 | Grageda | 373/76 |
| 5,153,894 | 10/1992 | Ehle et al. | 373/80 |

FOREIGN PATENT DOCUMENTS

| | | |
|---|---|---|
| 2659827 | 4/1978 | Germany . |
| 2825528 | 6/1978 | Germany . |
| 2907511 | 2/1979 | Germany . |

*Primary Examiner*—Bruce A. Reynolds
*Assistant Examiner*—Tu Hoang
*Attorney, Agent, or Firm*—Remy J. VanOphem; John VanOphem

[57] ABSTRACT

A cooling panel for use in drawing off excess heat from and protecting the side walls and roof of a furnace such as an electric arc furnace, the cooling panel being preferably made entirely out of oxygen-free pure copper. The cooling panel is a wall having a series of strips welded on one side, the strips having recesses on the side adjacent the wall to form channels between the strips and wall for circulating a cooling fluid therethrough. The cooling panel is also provided with inlet and outlet manifolds for supplying and removing the cooling fluid to the passages of the cooling panel. The strips and the manifolds are preferably made using an extruding process and assembled using a tungsten inert gas welding process.

23 Claims, 2 Drawing Sheets

WATER COOLED COPPER PANEL FOR A FURNACE AND METHOD OF MANUFACTURING SAME

BACKGROUND OF THE INVENTION

1. Field of the Invention

The present invention is directed to providing localized cooling of wall sections for furnaces and in particular to a water cooled panel for use in an electric arc furnace.

2. Description of the Prior Art

Arc furnaces are commonly used for producing steel and other metals and alloys. Historically, arc furnaces, and in particular electric arc furnaces, have been constructed of a steel structure and have a refractory material lining typically in the form of a bowl. The electric arc furnace has a set of electrodes which carry an electrical current used to melt material, such as scrap metal or pelletized iron sponge, which is turned into molten metal. The arc furnace is typically constructed such that new material to be melted can be continuously added and the molten metal can be drawn off at a continuous rate. U.S. Pat. No. 4,617,673, to Fuchs et al., discloses an example of this type of an electric arc furnace.

In order for the arc furnace to melt the material into molten metal, the electrical current arcs from the electrodes to the metal and back thereby raising its temperature and melting the material. Temperatures in the arc furnace can typically reach several thousand degrees Celsius. These relatively hot temperatures result in excessive wear of the refractory brick material as well as the furnace structure resulting in relatively rapid deterioration of the furnace. This rapid wearing of the furnace walls becomes extremely significant and very costly considering that the furnace must be shut down and allowed to cool before the excessively worn areas of the walls and roof can be repaired. Typically, current furnace wall and roof assemblies only last a short time before they must be repaired or replaced.

These problems have led to significant efforts and attempts to provide varying types of arc furnace wall and roof constructions which cost less and have an extended life. These efforts have led to advances which have focused upon providing devices which can either cool the refractory material of the furnace or completely replace it with a material which can withstand such temperatures. The advances have been along several lines. In particular, different materials have been used and different devices developed for cooling the wall and roof in an attempt to extend the useful life of the side and roof panels of the furnace.

In order to prolong the useful life of the furnace walls and roof, it is well known to provide a means for protecting the walls and roof from heat and also to draw off excess heat. With respect to cooling the wall and roof, many designs have been proposed which purport to solve certain problems with prior art designs, however, while some of the prior art designs have extended the useful life of the furnace walls and roof, there is still a great need to further extend their useful lives, while simultaneously providing a design which is overall less costly and easy to manufacture.

It is well known in the art to provide a cooling panel connected to the wall or roof of the furnace to remove the excess heat therefrom. These cooling panels can take many different forms and can operate upon different principles. It is also well known to circulate a cooling fluid in a serpentine path through machined channels in a hollowed wall. Several United States patents directly disclose the idea of using machined passages formed in a panel and having cooling water circulated therethrough to provide a means of cooling the panel. In particular, U.S. Pat. No. 4,453,253, to Lauria et al., discloses an arc furnace constructed using graphite blocks having panels containing machined serpentine conduits for circulating a cooling fluid to remove heat from the graphite block; these panels are attached to the outer surface of the furnace. Lauria et al. teach that by using liquid cooled graphite blocks the useful life of the furnace wall is extended due to the insulative properties of graphite. Lauria et al. further disclose that the outer surface cooling panel attached to the block is preferably made of a metal with the particular machining construction of the conduits being a matter of choice and that the cooling panel may be attached to the graphite block using bolts, cement or the like, individually or collectively. Lauria et al. further teach that graphite, unlike metal, will not burn through if arcing occurs on the hot face of the furnace wall.

U.S. Pat. No. 4,207,060 to Zangs also discloses a machined cooling wall for a furnace formed of a cooling pipe coil in which cooling water is circulated and is used to cool the heat resistant interior wall of an arc smelting furnace. Similar to Zangs, U.S. Pat. No. 4,637,034 to Grageda also discloses a machined water cooling panel for use in a metallurgical furnace. Grageda discloses that the panel is formed using parallel pipes connected at their ends to headers or a box-type cooler formed of steel plates or sheet steel. The parallel pipes are arranged to define a serpentine path for the cooling fluid. Grageda discloses that fluid orifices are provided to permit a minor amount of flow through the baffle near the cut-backs of the serpentine path to prevent water from stagnating and creating a hot spot or steam bubble in the wall. Additionally, U.S. Pat. No. 4,273,949, to Fischer et al., discloses an arc furnace roof made of segments having cooling fluid inlet and outlets therein for circulating cooling fluid through the roof panels of the furnace. Fischer et al. teach that by circulating cooling fluid in the roof panels the necessity of lining the associated segments with refractory lining is eliminated.

While all of the above references have improved the overall level of the art with respect to providing various alternatives which help to extend the useful life of the walls and roof of a furnace and therefore also the time between shut downs of the furnace, none of these references disclose or teach a device which has a high thermal conductivity, can be produced at a relatively low cost with a minimum of manufacturing effort out of a single material, and significantly extends the useful life of the furnace resulting in significant cost savings because of reduced manufacturing costs and down time.

Thus, there is still a considerable need to provide a cooling panel for use in a wall or roof of an electric arc furnace which can be produced at a relatively low cost and which has a significantly longer useful life than known cooling panels.

SUMMARY OF THE INVENTION

The present invention relates to a new and uniquely constructed cooling panel for use in an electric arc furnace or the like and a method for making the new apparatus. More specifically, the present invention relates to a removably attached cooling panel which can be utilized as part or all of a wall or roof of an electric arc furnace; the cooling panel being preferably constructed entirely of copper. The cooling panel of the present invention has passages therein for circulating therethrough a cooling fluid, such as water, at a relatively cold temperature for removing heat from the copper panel and thereby the furnace. The copper cooling panel of the present invention is more durable than conventional furnace walls and other commonly known cooling panels and thus is less subject to wear, costs less to manufacture and provides superior performance characteristics as compared to other known types of cooling panels.

The cooling panel of the present invention is preferably constructed of copper which is known for its excellent thermal conductivity. The cooling panel consists of a copper wall and extruded copper strips having a passage defined therein. The copper construction of the present invention replaces the prior art steel panel construction designs. The strips are welded to one side of the copper wall to create a series of passages. The copper strips each have recesses formed therein during the extruding process. The strips are welded to the wall such that the recesses are adjacent the wall thereby forming passages between the strips and the wall. The strips are laid across the wall in a uniform fashion to create multiple passages across the wall. Extruded inlet and outlet manifolds, also preferably made of pure, oxygen-free copper, are connected to the respective ends of the strips and wall for supplying and removing the cooling fluid. It is possible to make the cooling panel according to the present invention in nearly any shape, size, thickness or configuration. Additionally, it is preferable to equip the cooling panel of the present invention with a device for collecting slag, thrown off by the melt of the furnace, on the side of the wall opposite the strips.

Preferably all of the parts of the cooling panel: the wall, strips, inlet manifold and outlet manifold are all made of oxygen-free, pure copper. Additionally, the pieces are preferably manufactured in such a way as to require no machining. Finally, all of the pieces of the cooling panel are preferably welded together using the tungsten inert gas copper welding process.

It is therefore an object of the present invention to provide a cooling panel for use in an electric arc furnace, the cooling panel being of unique construction and manufacture.

It is another object of the present invention to provide a cooling panel which is essentially a flat wall and a plurality of evenly spaced apart strips welded to one side of the flat wall, the strips each having passages formed therein on the side of the strip adjoining the wall.

It is a further object of the present invention to provide a cooling panel having an inlet and an outlet manifold connected thereto for supplying and removing, respectively, a cooling fluid from the cooling panel.

It is a further object of the present invention to provide a cooling panel which achieves the above stated objectives and which has all water passageways easily manufactured entirely out of copper.

It is another object of the present invention to provide a cooling panel satisfying the above stated objectives which has components that are extruded and therefore much less expensive to produce and require no machining.

It is yet another object of the present invention to provide a cooling panel which achieves the above stated objectives and has provisions for collecting slag thrown off by the melt of the furnace.

It is yet another object of the present invention to provide a cooling panel according to the present invention which accomplishes the above stated goals and is less expensive overall and has a longer useful life than known cooling panels.

Other objects and advantages of the present invention will become apparent from the following detailed description of the invention with reference being made to the accompanying drawings. First, a brief description of the drawings will follow.

DETAILED DESCRIPTION OF THE PREFERRED EMBODIMENT

Figure 1:
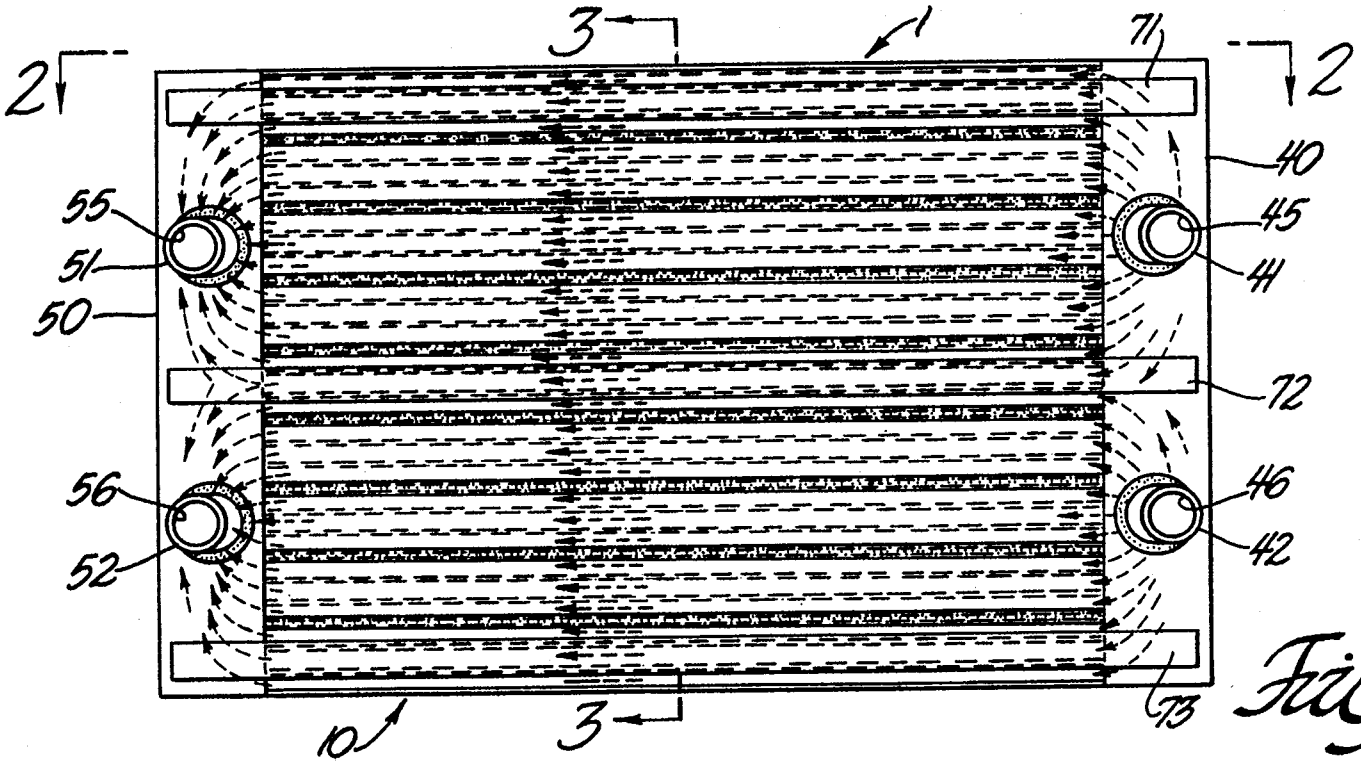
FIG. 1 is a plan view of the rear of a cooling panel constructed according to the present invention for use in an electric arc furnace wall or roof section.

Referring to the drawings, a cooling panel of novel construction and manufacture is disclosed. The cooling panel is generally designated by the numeral 1. The cooling panel 1 embodies a wall 10 which serves as a base for the cooling panel. The wall 10 has a back side 12 and a front side 14. The hot side is the back side 12 of the wall 10 which is exposed to the hot contents of the furnace. The wall 10 is preferably made out of oxygen-free copper. The wall 10 can be dimensioned and shaped accordingly depending upon the particular application for which it will be used. The wall 10 in the preferred embodiment shown in the drawings has a curvature along its length dimension such that the hot side 12 of the wall 10 is curved and the front side 14 of the wall is parallel thereto. The surfaces of the front side 14 and the hot side 12 are generally smooth.

Figure 4:
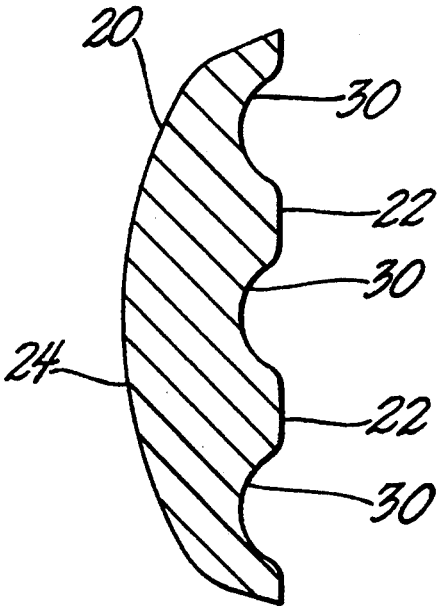
FIG. 4 is a cross-sectional view of an extruded cooling strip used in the cooling panel produced according to the present invention and illustrating the formation of the extruded recesses.

The wall 10 has an extruded strip 20 connected thereto which has recesses 30 formed therein. The strip 20 is also preferably formed of oxygen-free copper in an extruding process during which the recesses 30 are formed. The strip 20 is also formed so that its inner side 22 having the recesses 30 is curved along its length dimension such that it complements the curvature of the front side 14 of the wall 10. The strip 20 has an outer side 24 which has a concave cross section as shown in FIG. 4. The recesses 30 run the entire length of the strip 20 so that when the strip 20 is fixed to the wall 10 by welding, the recesses 30 create a passage running the entire distance between the strip 20 and the wall 10.

The recesses 30 are essentially scallops formed in the inner side 22 of the strip 20. It is possible to form the recesses 30 having a square, triangular or other shape, however, the recesses 30 shown in FIG. 4 are essentially round in order to provide a non-tortuous and smooth path for the cooling fluid to follow.

Figure 3:
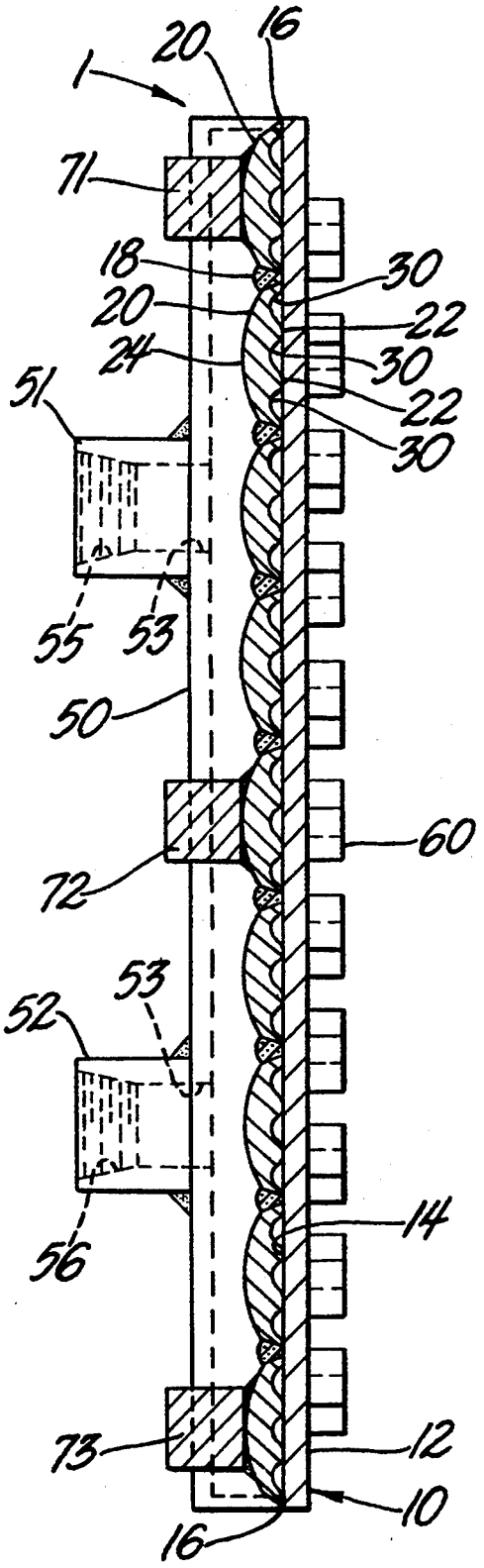
FIG. 3 is a sectional view taken along lines 3—3 of FIG. 1 illustrating the construction of the cooling panel.

The strip 20 is welded to the wall 10 using the tungsten inert gas process which will be explained later. The strips 20 are connected to the wall 10 in any conventional manner so long as the passages created by the recesses 30 are properly formed and are capable of carrying cooling fluid to properly cool the wall 10. As best illustrated in FIG. 3, the strips 20 are stacked along the width of the wall 10 such that they are evenly spaced apart and form a series of passages created by the recesses 30 through which the cooling fluid flows. Welds 18 are interposed the strips 20 and physically connect and hold the strips to the wall 10 and to one another. The end strips 20 are also welded to the ends of the wall 10 by welds 16.

Figure 2:
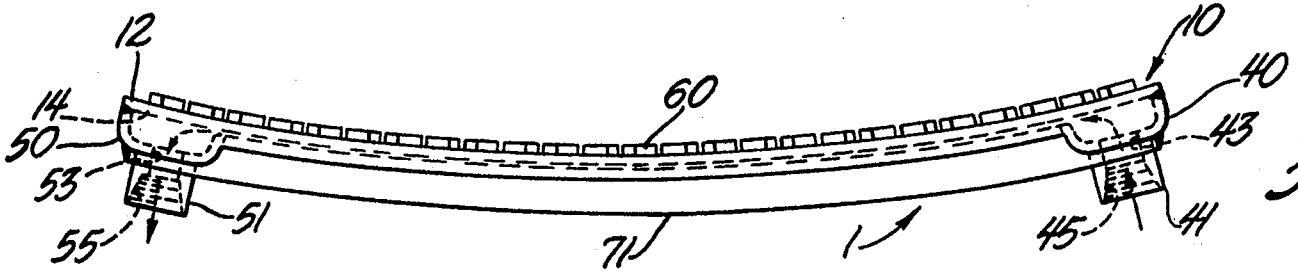
FIG. 2 is a plan view of a cooling panel according to the present invention looking in the direction of the arrows of lines 2—2 of FIG. 1.

The length of the strips 20 is chosen such that the strip will run the length of the wall 10 and be able to be connected to the wall 10 and inlet and outlet manifolds 40 and 50, respectively, of the strips 20, as best illustrated in FIGS. 1 and 2. The inlet manifold 40 is essentially a D-shaped section and is in communication with the openings of the recesses 30 in the ends of the strips 20. The inlet manifold 40 is also preferably made of oxygen-free copper and is formed using an extruding process. The inlet manifold 40 has a pair of inlet couplings 41 and 42 welded thereto and centrally aligned over a pair of inlet holes 43 located in the inlet manifold 40. The inlet couplings 41 and 42 include apertures 45 and 46, respectively, therethrough for attachment to a supply pipe in order to communicate the cooling fluid from supply hoses or pipes (not shown) to the inlet manifold 40. The cooling fluid supply hoses (not pictured) are connected to the inlet couplings 41 and 42 in a fluid-tight relation. The hoses are in turn connected to a pump (not shown) which supplies the relatively cold cooling fluid at a given pressure and temperature.

The outlet manifold 50 is provided on the outlet end of the strips 20 for collecting and removing the relatively warm cooling fluid once it has traveled the entire length of the cooling panel 1. The outlet manifold 50 is essentially a duplicate of the inlet manifold 40 but arranged to be connected to the outlet end of the strips and wall. The outlet manifold 50 itself is also a D-shaped extruded section and is also preferably made of oxygen-free, pure copper and formed in an extruding process. The outlet manifold 50 has a pair of outlet holes 53 advantageously located therein and a pair of outlet couplings 51 and 52 centrally located over the outlet holes 53 and welded to the outlet manifold 50. The outlet couplings 51 and 52 have apertures 55 and 56 therethrough concentrically located over the holes 53 of the outlet manifold 50. Similar to the inlet manifold 40, hoses or pipes (not pictured) are connected to the outlet couplings 51 and 52 for carrying off the relatively hot cooling fluid exiting the cooling panel 1 through the outlet manifold.

During the operation of a furnace, the impurities in the molten metal collect on top of the melt and form a layer of slag. In many furnaces and especially in an electric arc furnace, there is a great deal of agitation of the molten metal as the materials in the furnace are being charged and thereby melted. During the melting process, large amounts of molten metal and slag are thrown about within the interior volume of the furnace and thereby come into contact with the walls and roof of the furnace. As is well known in the art, in order to protect the walls of the furnace it is advantageous to provide a means for retaining some of the slag on the walls of the furnace in order to form an insulative and protective layer on the wall from the extreme heat caused by any splattering of molten metal contacting the hot side of the wall of the cooling panel.

In order to retain slag on the hot side 12 of the wall 10, the cooling panel 1 has on its hot side 12 a slag retaining means 60. The slag retaining means 60 is preferably a series of blocks arranged to prevent the slag from easily sliding off of the wall 10 and into the melt. Instead of sliding down the wall 10, slag thrown from splattering of molten metal being charged collects on the blocks 60 and cools to form an insulative and protective layer over the hot side 12 of the wall 10. It is possible to use different shaped blocks or other means for retaining the slag on the wall such as "v" or "c" shaped blocks or other known devices.

The welding process used to connect the strips 20 to the wall 10 can be any known process which will structurally rigidly connect the strips 20 to the wall 10 and provide for a solid fluid-tight seal between the strips 20 and the wall 10. However, it is preferable to connect the strips using a process which will be both cost efficient and will give desirable performance characteristics. In order to obtain the best possible connection and the best performance characteristics, it is preferable to use tungsten inert gas copper weld to secure the strips in a fluid-tight and structurally rigid manner. The use of a copper weld is particularly beneficial because the weld will expand and contract at the same rate as the components it holds together. This is significant considering that the cooling panel i goes through vast heat variations due to molten metal being splashed on its hot side face 12 and then is rapidly cooled off by the cooling fluid being circulated through the passages 30 of the strips 20.

Several techniques can be used to form the preferred oxygen-free pure copper weld used to attach the strips 20, the inlet and outlet manifolds 40 and 50, respectively, and the other components of the cooling panel 1. In particular, a tungsten-inert gas copper welding technique, well known in the art, is the preferred process for producing the required welds. As can best be seen in FIG. 3, the welds used to connect the strips 20 to the front side 14 of the wall 10 are relatively large. This is in part due to the particular formation of the strip 20. As noted above, the strip 20 has a concave back side in cross-section, thus, when two strips 20 are aligned side by side on the front side 14 of the wall 10, a relatively large area exists between the strips 20 because the strips 20 are spaced a predetermined distance apart. The distance between the strips 20 is chosen such that a sufficient amount of weld material can contact the wall 10 and create a sufficiently strong bond therewith to withstand the environment in which the cooling panel 1 will operate.

The weld 18 is produced so as to fill the entire area between two strips 20 and to cover enough of the concave surface of the outerside 24 of the strips 20 so as to create a sufficiently strong bond between the weld material 18, the strips 20 and the wall 10. The same welding process and considerations are also used in producing the end welds 16 between the strips 20 and the wall 10 and for the welds of the inlet and outlet manifolds and couplings.

Once the cooling panel 1 is completed and assembled, maneuvering bars 71, 72 and 73 are attached to the back side of the strips 20. The maneuvering bars 71, 72 and 73 are each attached to the outerside of a strip near the top, middle and bottom, respectively, of the wall 10 such that the maneuvering bars are evenly spaced apart. The maneuvering bars 71, 72 and 73 are preferably made out of steel. The use of steel for the maneuvering bars serves several purposes. First, the steel maneuvering bars give additional structural rigidity to the pure copper cooling panel 1. The use of steel provide for the different thermal expansion rates between the steel maneuvering bars and the preferably copper cooling panel, which is acceptable since the steel maneuvering bars are on the back side of the cooling panel and do not experience any extreme rapid temperature fluctuations like the wall 10 and the front side 22 of the strips 20 which directly contact the front side 14 of the wall 10. Second, since welding copper is considered to be difficult and is somewhat of a "black art", not every plant where the cooling panel may be used will have the materials readily available to do copper welding. Thus, the steel maneuvering bars 71, 72 and 73, give a person in such a plant a weldable material, steel, already attached to the cooling panel 1 to weld to as needed. Finally, the steel maneuvering bars 71, 72 and 73 can be used to lift and move the cooling panel 1 into and out of the roof or wall of the furnace during installation, maintenance and repair.

Thus, to install the cooling panel 1 in the wall or roof of a furnace, the cooling panel 1 is picked up by its maneuvering bars 71, 72 and 73 by any means necessary such as a Hi-Lo or a winch. The cooling panel 1 is then maneuvered into the appropriate space in the furnace wall and secured in place using any appropriate securing device such as bolts, clamps, welding or the like. Once the cooling panel 1 is in place, the cooling fluid inlet hoses or pipes (not pictured) are connected to the inlet couplings 41 and 42. Similarly, the cooling fluid outlet hoses or pipes (not pictured) are connected to the outlet couplings 51 and 52. Next, cooling fluid is allowed to slowly flow into the inlet manifold 40 of the cooling panel 1 and to fill all of the passages 30 of the strips 20 and the outlet manifold 50. Once the cooling panel 1 is filled with cooling fluid and properly pressurized, the cooling fluid flows through each strip continuously to remove the heat produced by the furnace.

once all of the cooling panels in the furnace (not pictured) are installed, the furnace is started and the material to be melted in the furnace is heated until it turns into molten metal. During the melting process, sparks and showers of molten metal and slag are splashed on the furnace roof and walls and thereby come into contact with the cooling panel 1. Additionally, the heat radiated and conducted from the molten metal mass is transferred through the interior volume of the furnace and into the furnace roof and walls. These factors cause the hot side 12 of the wall 10 of the cooling panel 1 to become extremely hot. Thus, as the relatively cold cooling fluid enters the strips 20 near the inlet manifold 40, heat is drawn out from the wall 10 and the cooling fluid's temperature rises as it moves across the wall 10. Once the cooling fluid passes through the respective recesses 30 of the strips 20 of the cooling panel 1, the outlet manifold receives the now relatively warm cooling fluid and passes it to the outlet hoses (not pictured) for removal from the panel.

Additionally, during the melting process, as the cooling panel 1 is heated and cooled it rapidly expands and contracts. Since copper is an excellent conductor of heat and the entire cooling panel is preferably made out of oxygen-free pure copper, the parts of the cooling panel 1 shrink and expand at the same rate thereby reducing the internal stresses in the parts and the welds connecting the respective parts of the cooling panel 1.

While the invention has been described in terms of a preferred embodiment, it is apparent that other forms could be adopted by one skilled in the art. Accordingly, the scope of the invention is to be limited only by the following claims.

What is claimed is:

1. A cooling panel for use as part of a wall or roof of an electric arc furnace having an interior volume, said cooling panel comprising:

a first substantially flat copper panel having a first side for exposure to said electric arc furnace and a second side; and a copper bar having a first side welded to said second side of said copper panel, said copper bar having a plurality of recesses located in said first side of said cooper bar such that said plurality of recesses form a plurality of straight-line, non-serpentine conduits between said copper bar and said second side of said copper panel whereby fluid flows therethrough and cools said first substantially flat copper panel.

2. The cooling panel of claim 1 wherein said copper bar is an extruded form.

3. The cooling panel of claim 1 further comprising:

means attached to said first side of said copper panel for collecting slag while said electric arc furnace is in operation such that said first side of said copper panel is coated with said slag thereby creating an insulating layer between said copper panel and said interior volume of said arc furnace.

4. The cooling panel of claim 2 further comprising means for supplying cooling fluid to said copper panel, said supplying means attached to said copper panel and directly communicating with said plurality of straight-line, non-serpentine conduits.

5. The cooling panel of claim 4 further comprising means for removing said cooling fluid from said copper panel, said removing means attached to said copper panel and directly communicating with said plurality of straight-line, non-serpentine conduits.

6. The cooling panel of claim 4 wherein said supplying means comprises an inlet manifold attached to said copper panel for fluid communication therewith.

7. The cooling panel of claim 5 wherein said supplying means comprises an inlet manifold attached to said copper panel for fluid communication therewith.

8. The cooling panel of claim 7 wherein said removing means comprises an outlet manifold attached to said copper panel for fluid communication therewith.

9. The cooling panel of claim 5 wherein said removing means comprises an outlet manifold attached to said copper panel for fluid communication therewith.

10. The fluid-cooled copper panel of claim 6 wherein said inlet manifold is extruded.

11. The cooling panel of claim 8 wherein said outlet manifold is extruded.

12. A method for producing a cooling panel for use in a wall or roof section of a furnace and having a cooling fluid flowing therethrough, said method comprising the steps of:

selecting a first copper panel;

forming a first copper bar having a straight-line, non-serpentine recess located in one side thereof;

attaching said first copper bar to said first copper panel such that said recess is located adjacent said first copper panel;

forming an inlet manifold;

attaching said inlet manifold to said first copper panel and said first copper bar;

forming an outlet manifold; and attaching said outlet manifold to said first copper panel and said first copper bar;

whereby said straight-line, non-serpentine recess conveys said cooling fluid from said inlet manifold, through said recess directly to said outlet manifold.

13. A cooling panel for use as part of a wall or roof of a furnace having an interior volume, said cooling panel comprising:

a panel member having a first side for exposure to said interior volume of said furnace and a second opposite side;

at least one extruded bar having a first end and a second end, said at least one extruded bar being attached to said second opposite side of said panel member; and extruded passage means interposed said panel member and said at least one extruded bar, said extruded passage means extending from said first end to said second end of said at least one extruded bar, said extruded passage means defining a straight-line, non-serpentine opening through which a cooling fluid flows whereby said cooling fluid entering said opening flows directly from said first end to said second end defined by said extruded passage means so as to extract heat from said panel member.

14. The cooling panel of claim 13 further comprising means for supplying cooling fluid to said cooling panel, said supplying means attached to said panel member.

15. The cooling panel of claim 14 further comprising means for removing said cooling fluid from said cooling panel, said removing means attached to said panel member.

16. The cooling panel of claim 15 wherein said supplying means comprises an inlet manifold attached to said cooling panel for fluid communication therewith.

17. The cooling panel of claim 16 wherein said removing means comprises an outlet manifold attached to said panel member for fluid communication therewith.

18. The cooling panel of claim 16 wherein said inlet manifold is extruded.

19. The cooling panel of claim 17 wherein said outlet manifold is extruded.

20. The cooling panel of claim 13 further comprising:

means attached to said first side of said panel member for collecting slag while said furnace is in operation such that said first side of said panel member becomes coated with said slag thereby creating an insulating layer between said panel member and said interior volume of said furnace.

21. The method according to claim 12 wherein said step of forming said first copper bar having said straight-line, non-serpentine recess located in one side thereof further comprises the step of extruding said first copper bar and said straight-line, non-serpentine recess located in one side thereof.

22. The method according to claim 21 wherein said step of attaching said first copper bar having straight-line, non-serpentine recess located in one side thereof to said first copper panel further comprises the step of welding said first copper bar to said first copper panel.

23. The method according to claim 22 wherein said welding step comprises the step of using a copper-tungsten inert gas welding method to weld said first copper bar to said first copper panel.

* * * * *

UNITED STATES PATENT AND TRADEMARK OFFICE

CERTIFICATE OF CORRECTION

PATENT NO. : 5,426,664
DATED : June 20, 1995
INVENTOR(S) : Robert C. Grove

It is certified that error appears in the above-indentified patent and that said Letters Patent is hereby corrected as shown below:

Column 2, line 40, delete "inlet" insert ---- inlets ----.

Column 3, line 67, after "and" insert ---- which ----.

Column 6, line 30, delete "i" insert ---- 1 ----.

Column 7, line 5, delete "provide" insert ---- provides ----.

Column 7, line 41, delete "once" insert ---- Once ----.

Column 8, line 16, delete "cooper" insert ---- copper ----.

Signed and Sealed this

Fifth Day of September, 1995

*Attest:*

Bruce Lehman

BRUCE LEHMAN

*Attesting Officer*

*Commissioner of Patents and Trademarks*